US007526837B2

(12) United States Patent
Maximov

(10) Patent No.: US 7,526,837 B2
(45) Date of Patent: May 5, 2009

(54) METHOD FOR TREATING FLAX FIBRE

(76) Inventor: Vladimir Vladimirovich Maximov, Schelkovo, UI, Bahchivandji, 11, Flat 90, 14110 Moscow Region (RU)

( * ) Notice: Subject to any disclaimer, the term of this patent is extended or adjusted under 35 U.S.C. 154(b) by 285 days.

(21) Appl. No.: 10/557,518

(22) PCT Filed: May 30, 2003

(86) PCT No.: PCT/RU03/00248

§ 371 (c)(1),
(2), (4) Date: Mar. 9, 2006

(87) PCT Pub. No.: WO2005/001172

PCT Pub. Date: Jan. 6, 2005

(65) Prior Publication Data

US 2007/0294862 A1 Dec. 27, 2007

(30) Foreign Application Priority Data

May 20, 2003 (RU) ..... 2003114717

(51) Int. Cl.
*D01B 1/14* (2006.01)

(52) U.S. Cl. ..... 19/7

(58) Field of Classification Search ..... 19/7, 19/5 R, 5 A

See application file for complete search history.

(56) References Cited

U.S. PATENT DOCUMENTS

| | | | | |
|---|---|---|---|---|
| 2,070,273 | A * | 2/1937 | Haughey | 19/7 |
| 2,403,331 | A * | 7/1946 | Best | 19/7 |
| 2,721,358 | A * | 10/1955 | Litvan et al. | 19/7 |

FOREIGN PATENT DOCUMENTS

| | | |
|---|---|---|
| FR | 2636350 | 3/1990 |
| NL | 398421 | 11/1990 |
| RU | 309982 | 2/1972 |
| RU | 2109859 C1 | 4/1998 |
| RU | 21415445 C1 | 11/1999 |

* cited by examiner

*Primary Examiner*—Shaun R Hurley
(74) *Attorney, Agent, or Firm*—Erickson Law Group, PC

(57) ABSTRACT

The method of treating the flax fiber consists of cleaning, cottonisation, retting and drying of the raw material, which could be short flax fiber No 2, combing wastes and other wastes. The opening of the flax fiber is carried out 3 times: first before the cleaning, second before the retting, and third after drying, which is done after cottonisation. This is carried out by electro-hydraulic treatment to a processed material placed in a liquid. This invention allows for quality improvement of the flax fibers and simplification of the processing.

1 Claim, 1 Drawing Sheet

METHOD FOR TREATING FLAX FIBRE

TECHNICAL FIELD OF THE INVENTION

Figure 1:
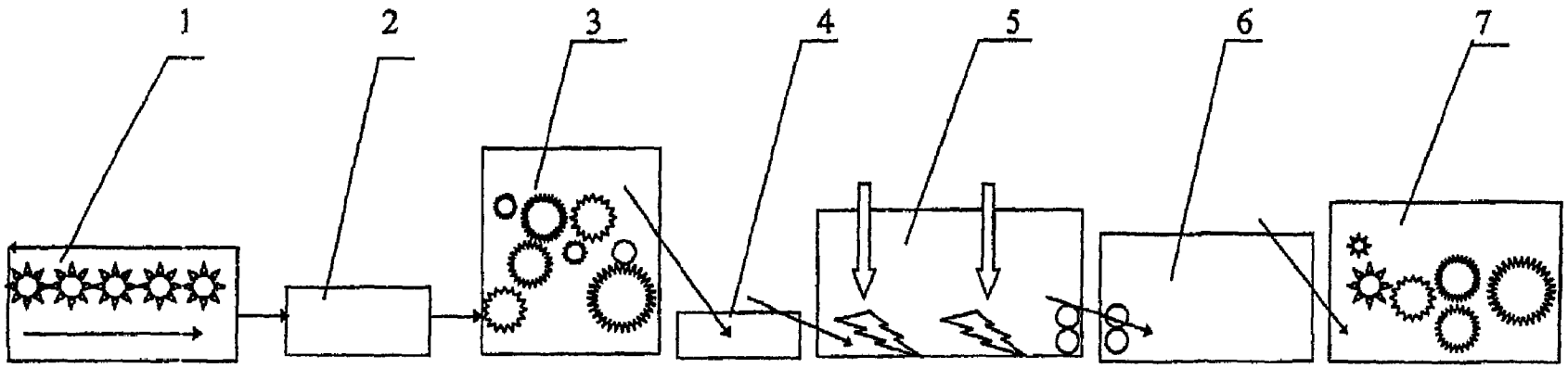

This invention refers to the textile industry, i.e. methods of flax fibres treatment.

BACKGROUND OF THE INVENTION

Out of all the flax fibres produced in Russia, 60-70% is represented by short flax fibres. The equipment of the cotton and woolen manufacturers is not suited for the processing of the flax fibre, as it is, unless it has been put through the cottonisation process, which modifies the characteristics of flax fibre, making it more cotton like.

The sequential processing line for treatment of flax fibres (patent RU 2109859C1 D01 G21/00, 1998) includes cleaning, opening and cottonisation of flax fibres. Disadvantages of this method are the low quality of the treated flax fibre and the complication of the treatment method.

SUMMARY OF THE INVENTION

The aim of the invention is to improve the quality of the treated flax fibre and simplification of the processing.

Getting rid of the deficiencies of the process stated is achieved through adding the retting and drying stages to the original process (cleaning, opening and cottonisation). The opening here is carried out 3 times: firstly before the cleaning, secondly before the retting, and finally after drying which takes place after cottonisation which is done by means of electro-hydraulic action on the processed material while placed in liquid.

DETAILED DESCRIPTION OF THE INVENTION

The indicated method of flax fibre treatment is implemented on a technological line shown in FIG. 1.

The initial raw material, which could be short flax fibre No 2, the combing wastes and other wastes, are loaded into the technological line, where it is being opened by means of the automatic self-feeder—bale opening machine 1, where the fibres taken from the bale are being opened, and then the opened fibres are fed into the "shaking" machine 2, where the shives and other vegetable matter are partially removed.

Then the fibres are fed into section 3, which consists of the splitting—loosening—cleaning machine (like type RChK-1), where the fibres are being loosened by the garnitures of the drums and further removal of shives and other vegetable matter is carried out. After this the flax fibres are being placed into the connecting feedthrough bath 4, where the fibres are being retted in the liquid.

The wet fibres are then put through the cottonisation process by placing them into the working chamber 5, full of liquid (water or cleaning solution), where the fibres are being treated by electro-hydraulic action by means of electric discharge between the electrodes. The gap between the electrodes should be 80 mm, the output voltage of the rectifier-transformer—45 kV, the pulse frequency—1 Hz. As a result the output fibres are cottonised with the length of 15-60 mm and the linear density of 0.2-0.6 tex. The cottonised fibres are then dried in the drying chamber 6, after which the final clumps of cottonised fibres are further opened on the opening machine 7 (for opening the woollen clumps like type MARSh-1).

The flax fibres achieved through this methodology have high levels of softness, light silver colour and characteristics close to cotton fibres. This allows addition of these fibres into the blend on the opening machine on the cotton technological line and production of flax yarns that can be used to manufacture fabrics.

The invention claimed is:

1. A method of flax fibres treatment, comprising the steps of opening the flax fibres, and sequentially of the steps of cleaning, retting, cottonisation and drying, wherein:

opening of the flax fibres is carried out three times, firstly before cleaning, secondly before retting and thirdly after cottonisation; and cottonisation is done by means of electro-hydraulic action on the processed material while placed in liquid.

* * * * *